US008997830B1

(12) United States Patent
Lee

(10) Patent No.: US 8,997,830 B1
(45) Date of Patent: Apr. 7, 2015

(54) DRAPE ASSEMBLY

(71) Applicant: Marcia S. Lee, Montgomery, AL (US)

(72) Inventor: Marcia S. Lee, Montgomery, AL (US)

( * ) Notice: Subject to any disclaimer, the term of this patent is extended or adjusted under 35 U.S.C. 154(b) by 78 days.

(21) Appl. No.: 13/778,423

(22) Filed: Feb. 27, 2013

(51) Int. Cl.
*A47H 7/00* (2006.01)
*A47H 1/04* (2006.01)
*A47H 1/144* (2006.01)

(52) U.S. Cl.
CPC .. *A47H 7/00* (2013.01); *A47H 1/04* (2013.01); *A47H 1/144* (2013.01)

(58) Field of Classification Search
CPC ..... A47H 1/02; A47H 1/04; A47H 1/142; A47H 1/144
USPC ..... 160/330, 370.21, 370.22, 24, 350, 126; 248/262; 296/138; 211/105.1; 16/96 D
See application file for complete search history.

(56) References Cited

U.S. PATENT DOCUMENTS

| | | | | | |
|---|---|---|---|---|---|
| 1,023,069 | A | * | 4/1912 | Cole | 160/345 |
| 1,206,421 | A | * | 11/1916 | Dickey et al. | 16/87.4 W |
| 3,380,111 | A | * | 4/1968 | Segerstad | 16/94 R |
| 3,688,341 | A | | 9/1972 | Peckham | |
| 4,202,074 | A | * | 5/1980 | Hard Af Segerstad | 16/94 D |
| 4,237,958 | A | | 12/1980 | Guebert et al. | |
| 4,581,788 | A | * | 4/1986 | Baumann | 16/93 D |
| 4,736,980 | A | * | 4/1988 | Eubanks | 160/370.22 |
| 5,191,922 | A | | 3/1993 | Wade | |
| 5,230,494 | A | * | 7/1993 | Adams | 248/266 |
| D415,014 | S | | 10/1999 | Bruton | |
| 6,334,477 | B1 | | 1/2002 | Moir | |
| 6,824,000 | B2 | | 11/2004 | Samelson | |

* cited by examiner

*Primary Examiner* — Blair M Johnson

(57) ABSTRACT

A drape assembly facilitates replacement of curtains without tools and without disassembling or taking down a curtain rod. The assembly includes a suction cup that may be coupled to a support surface. A tubular rod is removably coupled to the suction cup so the tubular rod is spaced from the support surface. A coupler is slidably coupled to the tubular rod so the coupler is movable between a first end and a second end of the tubular rod. A drape is selectively coupled to the coupler so the drape extends downwardly from the tubular rod.

8 Claims, 4 Drawing Sheets

DRAPE ASSEMBLY

BACKGROUND OF THE DISCLOSURE

Field of the Disclosure

The disclosure relates to drape devices and more particularly pertains to a new drape device for replacing curtains without tools and without disassembling or taking down a curtain rod.

SUMMARY OF THE DISCLOSURE

An embodiment of the disclosure meets the needs presented above by generally comprising a suction cup that may be coupled to a support surface. A tubular rod is removably coupled to the suction cup so the tubular rod is spaced from the support surface. A coupler is slidably coupled to the tubular rod so the coupler is movable between a first end and a second end of the tubular rod. A drape is selectively coupled to the coupler so the drape extends downwardly from the tubular rod.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
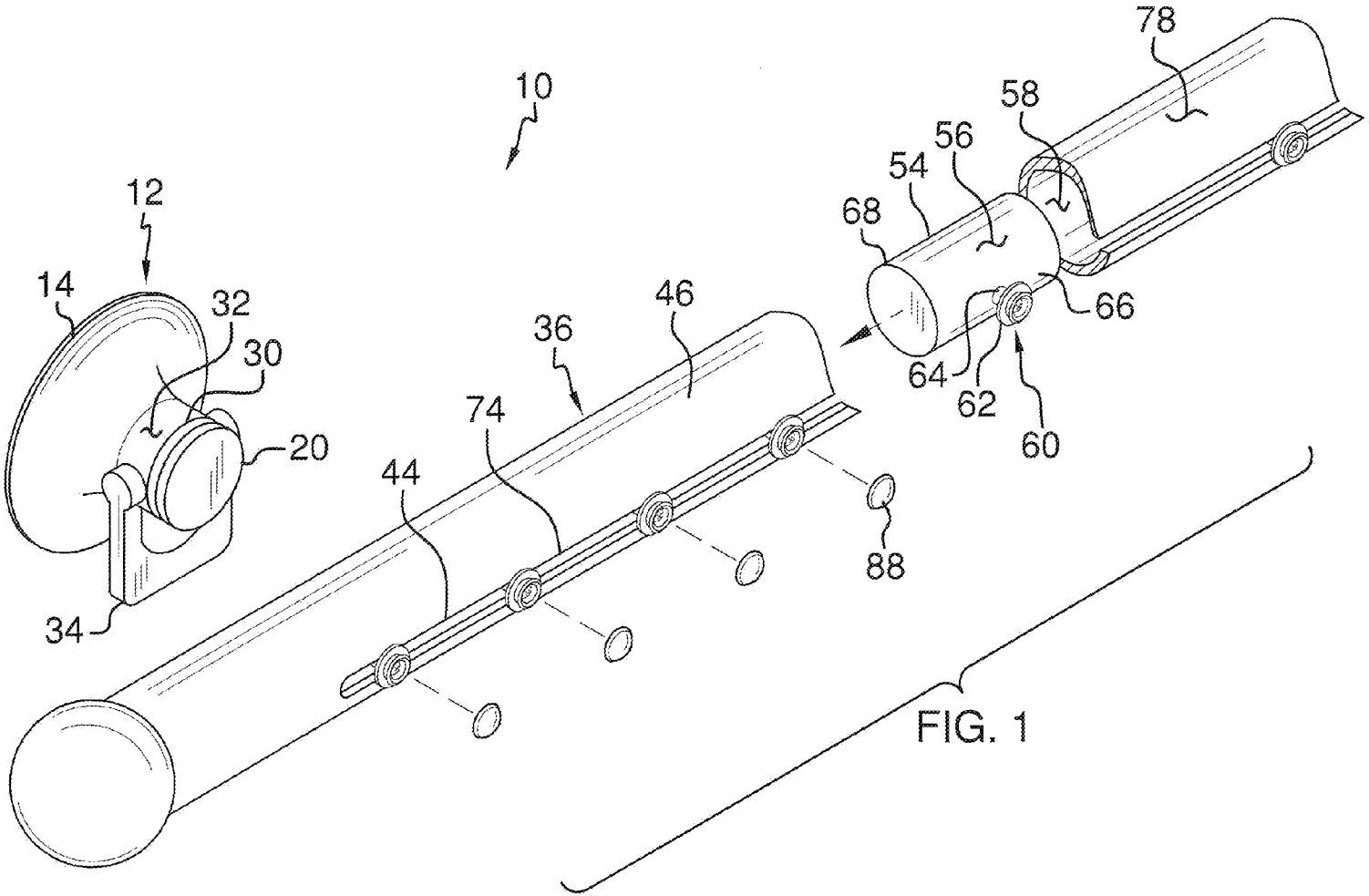
FIG. 1 is a perspective view of a drape assembly according to an embodiment of the disclosure.
Figure 2:
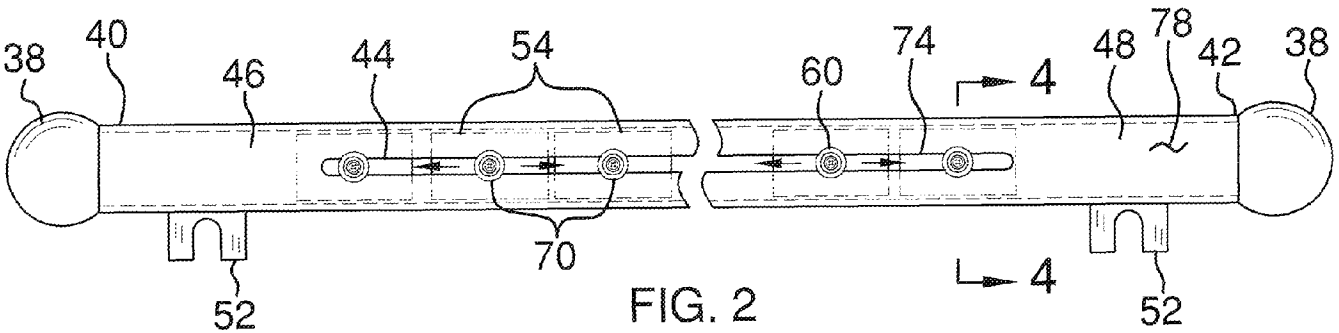
FIG. 2 is a front view of an embodiment of the disclosure.
Figure 3:
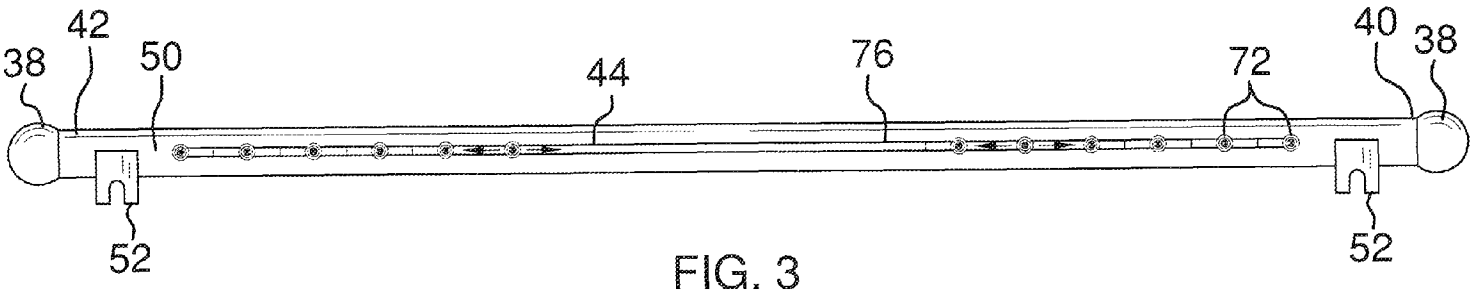
FIG. 3 is a back view of an embodiment of the disclosure.
Figure 4:
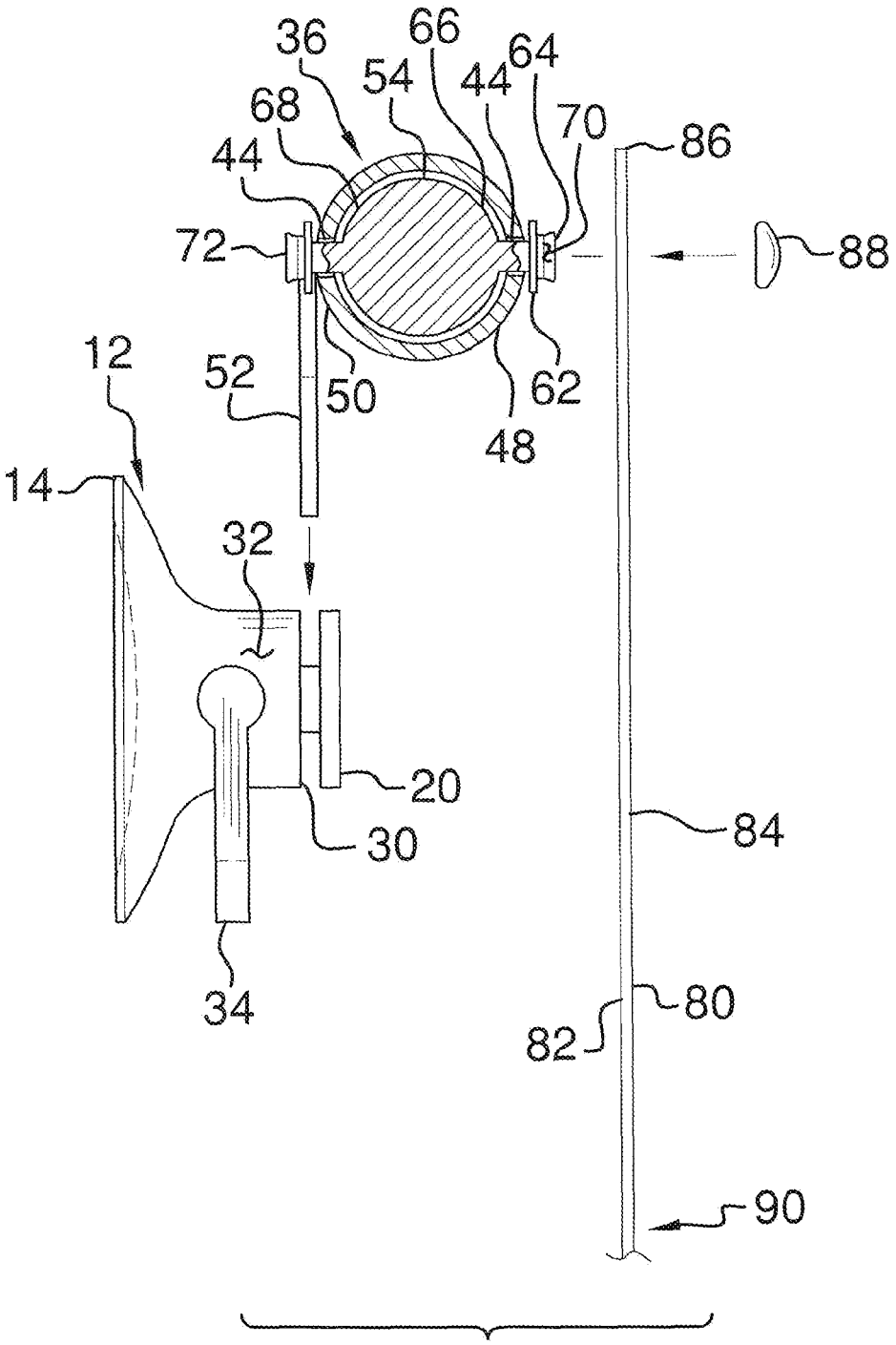
FIG. 4 is a cross sectional view taken along line 4.-4 of FIG. 2 of an embodiment of the disclosure.
Figure 5:
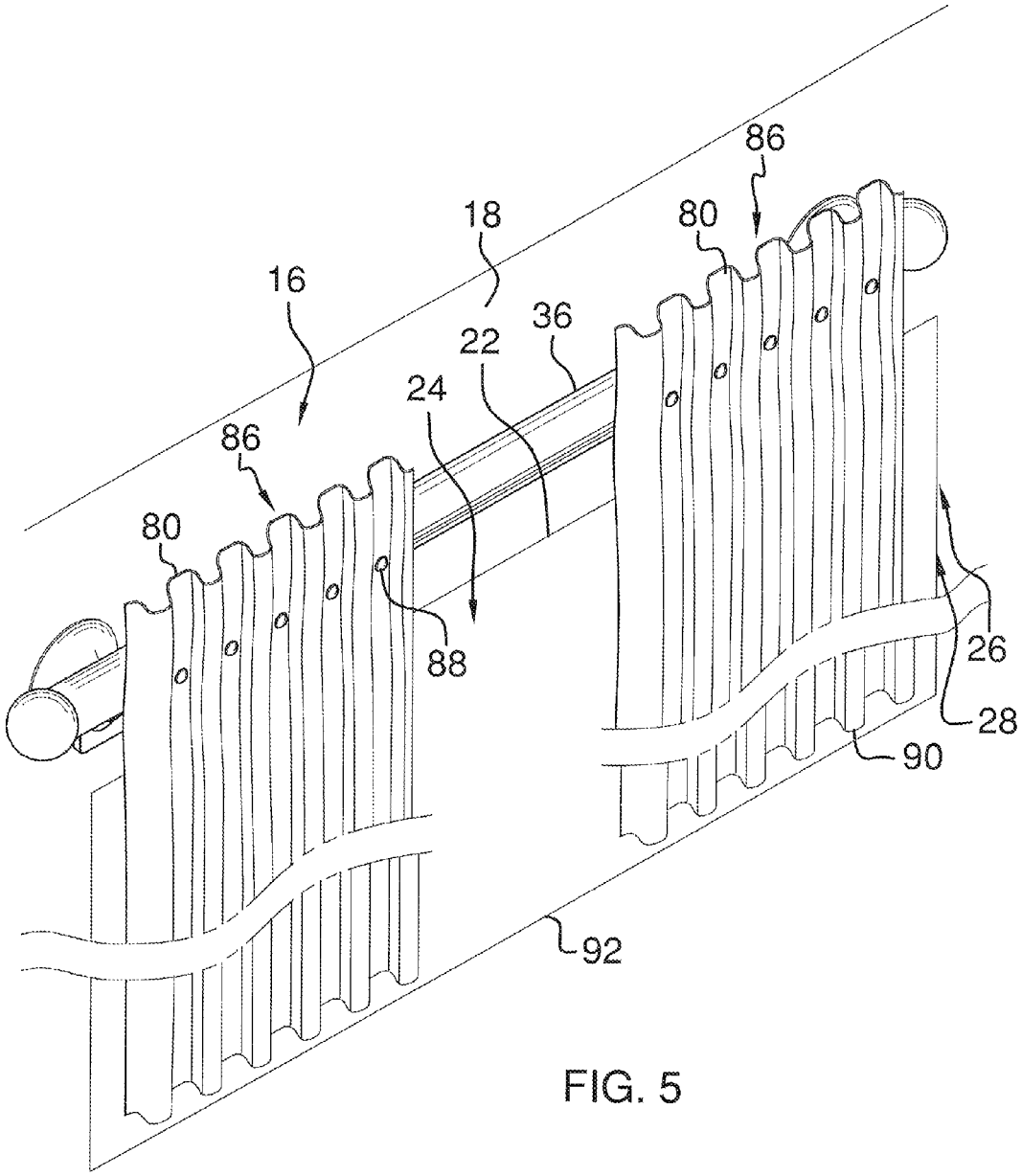
FIG. 5 is an in-use view of an embodiment of the disclosure.

With reference now to the drawings, and in particular to FIGS. 1 through 5 thereof, a new drape device embodying the principles and concepts of an embodiment of the disclosure and generally designated by the reference numeral 10 will be described.

As best illustrated in FIGS. 1 through 5, the drape assembly 10 generally comprises a suction cup 12. A coupling end 14 of the suction cup 12 selectively suctionally engages a support surface 16 so the suction cup 12 is retained on the support surface 16. The support surface 16 may be a wall 18. The coupling end 14 of the suction cup 12 has a diameter that is larger than a diameter of a free end 20 of the suction cup 12 so the suction cup 12 is bell shaped. Additionally, the suction cup 12 is one of a pair of the suction cups 12 that is each positionable on the support surface 16. Each of the suction cups 12 may be positioned on opposite sides of a top 22 of an opening 24 in the wall 18 so the pair of suction cups 12 is horizontally spaced apart. The opening 24 in the wall 18 may comprise a doorway 26 or a window 28 of any conventional design.

A groove 30 extends inwardly from an outside surface 32 of the suction cup 12 proximate the free end 20 of the suction cup 12. The groove 30 forms a closed loop that extends around an entire perimeter of the outside surface 32 of the suction cup 12. A handle 34 is movably coupled to the free end 20 of the suction cup 12. The handle 34 may be gripped to remove the suction cup 12 from the support surface 16.

A tubular rod 36 is removably coupled to the suction cup 12 so the tubular rod 36 is spaced laterally away from the support surface 16. In addition, the tubular rod 36 is positioned horizontally with respect to Earth. The tubular rod 36 may have a length between 1 in and 2 m. A pair of balls 38 is each coupled to an associated one of a first 40 and a second 42 end of the tubular rod 36. A slot 44 extends through an exterior wall 46 of the tubular rod 36 and the slot 44 extends between the first 40 and second 42 ends of the tubular rod 36. The slot 36 is one of a pair of slots 36 each positioned on an associated one of a front side 48 and a rear side 50 of the tubular rod 36.

A mount 52 is coupled to the rear side 50 of the tubular rod 36. The mount 52 has a U-shape so the mount 52 may selectively engage the groove 30 on the suction cup 12. The mount 52 extends downwardly around a coupling portion 53 of the suction cup 12 so the mount 52 is removably coupled to the suction cup 12. The mount 52 is one of a pair of mounts 52 each positioned proximate an associated one of the first 40 and second 42 ends of the tubular rod 36. The tubular rod 36 extends laterally across the top 22 of the opening 24 in the wall 18 when the mount 52 is coupled to the section cup 12.

A coupler 54 has a cylindrical shape and is positioned within an interior of the tubular rod 36. An outside surface 56 of the coupler 54 coextensively abuts an inside surface 58 of the tubular rod 36 so the coupler 54 is slidably coupled to the tubular rod 36. The coupler 54 is movable between the first end 40 and the second end 42 of the tubular rod 36. In addition, the coupler 54 may have a length between 3.5 cm and 6.5 cm. The coupler 54 is one of a plurality of couplers 54 each positioned within the interior of the tubular rod 36. The plurality of couplers 54 is distributed between the first 40 and second 42 ends of the tubular rod 36.

A centrally positioned snap 60 is coupled to and extends laterally away from the outside surface 56 of the coupler 54. A lip 62 extends outwardly from an outer surface 64 of the snap 60 proximate a free end 66 of the snap 60. Additionally, the snap 60 is one of a pair of snaps 60 each positioned on an associated one of a front side 66 and a rear side 68 of the coupler 54. A front one 70 and a rear one 72 of the snaps each extends through an associated one of a front 74 and a rear 76 slot in the tubular rod 36 so the lip 62 on each of the front 70 and rear 72 snaps is positioned proximate an outside surface 78 of the tubular rod 36.

A drape 80 is positionable on the plurality of couplers 54 so the front snap 70 on each of the couplers 54 extends through a back 82 and a front 84 of the drape 80 proximate a top 86 of the drape 80. A plurality of fasteners 88 is provided. Each of the fasteners 88 removably engages the free end 66 of an associated one of the plurality of snaps 54 so the drape 80 is removably coupled to the plurality of couplers 54. The drape 80 may be a curtain of any conventional design.

The drape 80 may be one of a pair of drapes 80. The pair of drapes 80 is positionable in an exposing position to expose the opening 24 in the wall 18. The pair of drapes 80 is positionable in a covering position to cover the opening 24 in the wall 18. The drape 80 extends downwardly from the tubular rod 36 so a bottom 90 of the drape 80 is positioned proximate a bottom 92 of the opening 24 in the wall 18.

In use, the assembly 10 may be positioned proximate the doorway 26 or the window 28. The drape 80 may be positioned in the covering position to provide shade or privacy for the doorway 26 or window 28. Further, the drape 80 may be positioned at a selected position between the covering position and the exposing position. The drape 80 may be removed from the couplers 54 for cleaning or routine maintenance With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A drape assembly comprising:

a pair of suction cups each being configured to be coupled to a support surface;

a tubular rod removably coupled to said suction cups wherein said tubular rod is spaced from the support surface, said tubular rod having an elongated front slot extending therethrough, said front slot being positioned opposite of said suction cups, said front slot extending between a first end and a second end of said tubular rod;

a coupler slidably coupled to said tubular rod wherein said coupler is movable between said first end and said second end of said tubular rod, said coupler being positioned within an interior of said tubular rod, an outer surface of said coupler abutting a bottom surface of an interior surface of said tubular rod, said coupler including a snap, said snap extending through said front slot; and a drape selectively coupled to said snap of said coupler wherein said drape extends downwardly from said tubular rod; and said front slot being in a front side of said tubular rod, a rear slot being positioned in a rear side of said tubular rod;

said snap being one of a pair of said snaps each positioned on an associated one of a front side and a rear side of said coupler, a rear one of said snaps extending through said rear slot.

2. The assembly according to claim 1, further comprising a coupling end of each of said suction cups selectively suctionally engaging the support surface wherein said suction cup is retained on the support surface, said support surface comprises a wall.

3. The assembly according to claim 2, further comprising said coupling end of said suction cup having a diameter being larger than a diameter of a free end of said suction cup wherein said suction cup is bell shaped.

4. The assembly according to claim 3, further comprising a groove extending inwardly from an outside surface of said suction cup proximate said free end of said suction cup wherein said groove extends around an entire perimeter of said outside surface of said suction cup.

5. The assembly according to claim 4, further including a pair of mounts coupled to a rear side of said tubular rod, said mounts each having a U-shape wherein said mounts selectively engage a groove on said suction cup wherein said mount is removably coupled to said suction cup.

6. The assembly according to claim 1, further comprising said coupler having a cylindrical shape wherein said outside surface of said coupler coextensively abuts an inside surface of said tubular rod, said cylindrical shape having an axis being a longitudinal axis oriented parallel to a longitudinal axis of said tubular rod.

7. The assembly according to claim 1, further comprising said coupler being one of a plurality of said couplers each positioned within an interior of said tubular rod wherein said plurality of couplers is distributed between said first and second end of said tubular rod.

8. A drape assembly comprising:

a suction cup comprising a coupling end of said suction cup selectively suctionally engaging a support surface wherein said suction cup is retained on the support surface, said coupling end of said suction cup having a diameter being larger than a diameter of a free end of said suction cup wherein said suction cup is bell shaped, said suction cup being one of a pair of said suction cups each being positionable on the support surface wherein said pair of suction cups is horizontally spaced apart;

a groove extending inwardly from an outside surface of said suction cup proximate said free end of said suction cup wherein said groove extends around an entire perimeter of said outside surface of said suction cup;

a tubular rod removably coupled to said suction cup wherein said tubular rod is spaced laterally away from the support surface and positioned horizontally with respect to Earth;

a slot extending through an exterior wall of said tubular rod wherein said slot extends between a first and a second end of said tubular rod, said slot being one of a pair of said slots each positioned on an associated one of a front side and a rear side of said tubular rod;

a mount coupled to said rear side of said tubular rod, said mount having a U-shape wherein said mount selectively engages said groove on said suction cup wherein said mount is removably coupled to said suction cup, said mount being one of a pair of said mounts each positioned proximate an associated one of said first and second ends of said tubular rod;

a coupler having a cylindrical shape, an outside surface of said coupler coextensively abuts an inside surface of said tubular rod wherein said coupler is slidably coupled to said tubular rod wherein said coupler is movable between said first end and said second end of said tubular rod, said coupler being one of a plurality of said couplers each positioned within an interior of said tubular rod wherein said plurality of couplers is distributed between said first and second end of said tubular rod, said cylindrical shape having an axis being a longitudinal axis oriented parallel to a longitudinal axis of said tubular rod;

a centrally positioned snap coupled to and extending laterally away from said outside surface of said coupler, said snap being one of a pair of said snaps each positioned on an associated one of a front side and a rear side of said coupler, a front one and a rear one of said snaps each extending through an associated one of a front and a rear slot in said tubular rod; and a drape being positionable on said coupler wherein each of said front snaps extends through a back and a front of said drape proximate a top of said drape wherein said drape is removably coupled to said coupler wherein said drape extends downwardly from said tubular rod.

* * * * *